US007698834B1

(12) United States Patent
Courville

(10) Patent No.: US 7,698,834 B1
(45) Date of Patent: Apr. 20, 2010

(54) SHOE WITH INTERCHANGEABLE VAMP AND BASE

(76) Inventor: Carolyn Courville, 1927 Long Shadow La., Spring, TX (US) 77388

( * ) Notice: Subject to any disclaimer, the term of this patent is extended or adjusted under 35 U.S.C. 154(b) by 666 days.

(21) Appl. No.: 11/690,846

(22) Filed: Mar. 25, 2007

Related U.S. Application Data

(60) Provisional application No. 60/865,165, filed on Nov. 9, 2006.

(51) Int. Cl.
*A43B 3/12* (2006.01)
*A43B 3/24* (2006.01)

(52) U.S. Cl. ..... 36/15; 36/100

(58) Field of Classification Search ..... 36/15, 36/11.5, 100, 101
See application file for complete search history.

(56) References Cited

U.S. PATENT DOCUMENTS

| | | | | | |
|---|---|---|---|---|---|
| 2,368,314 | A | * | 1/1945 | Marx | 36/11.5 |
| 2,438,711 | A | * | 3/1948 | Leach et al. | 36/101 |
| 2,491,930 | A | | 12/1949 | Parlante | |
| 2,519,108 | A | | 8/1950 | Bryant | |
| 2,552,943 | A | | 5/1951 | Danielus | |
| 2,583,826 | A | | 1/1952 | Fischer | |
| 2,761,224 | A | | 9/1956 | Gardiner | |
| 2,809,449 | A | | 10/1957 | Smith | |
| 2,887,795 | A | | 5/1959 | Taicher | |
| 2,948,070 | A | | 8/1960 | Lewis | |
| 3,032,896 | A | | 5/1962 | Weaver | |
| 3,204,346 | A | | 9/1965 | Lockard | |
| 3,902,259 | A | | 9/1975 | Cracco | |
| 4,267,649 | A | | 5/1981 | Smith | |
| 4,343,057 | A | * | 8/1982 | Bensley | 12/142 D |
| 4,363,177 | A | | 12/1982 | Boros | |
| 4,377,042 | A | * | 3/1983 | Bauer | 36/101 |
| 4,439,935 | A | | 4/1984 | Kelly | |
| 4,586,209 | A | * | 5/1986 | Bensley | 12/142 D |
| 4,887,369 | A | | 12/1989 | Bailey | |
| 5,065,531 | A | * | 11/1991 | Prestridge | 36/100 |
| 5,083,385 | A | | 1/1992 | Halford | |
| 6,874,256 | B2 | | 4/2005 | Delgatty | |
| 6,895,697 | B2 | | 5/2005 | Yang | |
| 7,028,420 | B2 | | 4/2006 | Tonkel | |
| 7,222,442 | B2 | | 5/2007 | Hillyer | |
| 7,318,260 | B2 | | 1/2008 | Pierce | |
| 7,318,289 | B2 | * | 1/2008 | Chan | 36/11.5 |
| 7,331,128 | B1 | | 2/2008 | Navasky | |
| 2002/0174569 | A1 | * | 11/2002 | Tsai | 36/101 |
| 2008/0098623 | A1 | | 5/2008 | Komitau | |

* cited by examiner

*Primary Examiner*—Marie Patterson

(57) ABSTRACT

Disclosed is a shoe system comprising an interchangeable shoe base and vamp. The shoe base has a rim piece on the outer edge of the shoe base that interlocks with a protruding lip on the outer edge of the vamp except in the toe area, where the rim piece and vamp abut one another rather than interlocking, allowing the interchangeable vamp to have a closed toe.

13 Claims, 3 Drawing Sheets

SHOE WITH INTERCHANGEABLE VAMP AND BASE

RELATED APPLICATIONS

This application claims the benefit of U.S. Provisional Patent Application No. 60/865,165, filed Nov. 9, 2006 by the present inventor, which is incorporated by reference.

BACKGROUND OF THE INVENTION

This invention is in the field of shoes. Shoes, particularly women's shoes, have both functional characteristics and design characteristics. Functional characteristics include heel height and shape and the nature of the back of the shoe, i.e. whether open-back, sling-back or closed back. Design characteristics include color, material, and decorative elements such as buckles, piecing, stitching or other ornamental features. Matching both the functional and design characteristics of women's dress, business or fashion leisure shoes with women's dress, business or fashion leisure clothing can be difficult. Business or dress shoes usually have a slim outline, with a thin sole and no protruding welt. Many dress and business occasions call for closed-toe shoes rather than open-toe shoes or sandals. In addition, closed-toe shoes are required for the winter months. The related prior art has limitations that prevent the disclosed art from being applicable to a closed-toe dress shoe. Attempts to provide an interchangeable vamp or upper have produced bulky or complex mechanisms unsuited for women's dress shoes. Smith, U.S. Pat. No. 2,809,449 disclosed an upper attached to the sole with a zipper-like slide fastener unsuited for women's dress shoes. Gardiner, U.S. Pat. No. 2,761,224 disclosed a shoe with a hollow welt for a detachable upper, where the connecting means is embedded into the welt and sole of the shoe, resulting in a thick sole and protruding welt. Halford, U.S. Pat. No. 5,083,385 disclosed an insole/outsole combination with a thickened sole suitable for an outdoor or athletic shoe.

The toe area of a shoe presents a particular problem for interchangeable vamps or uppers because the tapered shape of the toe area must be taken into account. Other prior art avoids the design complications of a closed toe shoe by being applicable only to an open-toe sandal design. Kelly, U.S. Pat. No. 4,439,935 disclosed a convertible shoe upper comprised of an insole and vamp unit construction with a hook and loop fastener, a design suitable only for a sandal. Boros disclosed in U.S. Pat. No. 4,363,177 a channel inserted within the shoe base that does not make any provision for a closed toe and that requires a thick sole. Tonkel disclosed in U.S. Pat. No. 7,028,420 a sandal-type shoe with a slot into which a reversible vamp is inserted. The patent issued to Yang, U.S. Pat. No. 6,895,697 disclosed a strap shoe with a complex system of buckling bases and strap slots forming a sandal. The patent issued to Lockard, U.S. Pat. No. 3,204,346 also makes no provision for a closed toe shoe. U.S. Pat. No. 4,267,649 issued to Smith disclosed a sandal type shoe with a wedgie heel unsuited for dress or business wear.

Other prior art provides for certain design elements to be interchangeable, but the disclosed interchangeable device does not comprise the entire vamp or upper section, limiting the design characteristics that can be interchanged. In U.S. Pat. No. 2,887,795, Taicher disclosed an interchangeable design element that is attached to the top of the vamp of the shoe. Similarly, in U.S. Pat. No. 2,583,826, Fischer disclosed a system of interchangeable panels in a vamp, but the entire vamp is not interchangeable. Weaver, U.S. Pat. No. 3,032,896 disclosed a backless sandal with an arcuate vamp cover snapped to the shoe base. In addition to being suitable only for an open-toe shoe, the snapping mechanism prevents the shoe from having the sleek appearance necessary for women's dress shoes.

It is an object of this invention to provide a dress, business or fashion leisure shoe having a vamp or shoe base which can be interchanged to complement the wearer's clothing selection or activity. It is a further object of the invention that the wearer can utilize a vamp having favored design characteristics with multiple shoe bases. It is a further object of the invention that the shoe have the appearance of a standard dress or business shoe, being capable of having a thin sole and no protruding welts. It is a further object that the shoe can have either a closed toe or an open toe.

BRIEF SUMMARY OF THE INVENTION

The invention is a shoe suitable for dress, business or fashion leisure wear with interchangeable vamp and shoe base, the replacement process being capable of performance within a few seconds. The vamp and shoe base are attached by interlocking a channelized rim piece on the longitudinal margins of the shoe base and a lip on the corresponding margins of the vamp. The lip of the vamp is inserted into the channel in the interlocking rim piece, first on one side of the shoe base then the other. A segment of the shoe base near the toe has a rim piece that abuts the vamp rather than interlocking with the vamp in order to accommodate the triangular toe area. Magnetization or shaping of the interlocking rim piece and lip may be used to aid placement and retention of the vamp. The vamp may be closed toe or open toe.

DETAILED DESCRIPTION OF THE PREFERRED EMBODIMENTS

In the following discussion, "inside margin" refers to the longitudinal margin of a shoe that, when the wearer is standing with the feet together, is closest to the other foot. In the following discussion, "outside margin" refers to the longitudinal margin of the shoe that, when the wearer is standing with the feet together, is farthest from the other foot. In the following discussion, "proximal" refers to the area of the shoe near the wearer's legs; "distal" refers to the area of the shoe near the toe. In the following discussion, "heel area" refers to the approximate one-third of the shoe surrounding or contacting the wearer's heel; "toe area" refers to the approximate one-third of the shoe surrounding or contacting the wearer's toes, and "instep area" refers to the approximate one-third of the shoe between the heel area and the toe area; "outer midpoint" refers to a location on the outer margin of the shoe which is approximately the same distance from the toe of the shoe as is the instep on the inner margin of the shoe.

Figure 1:
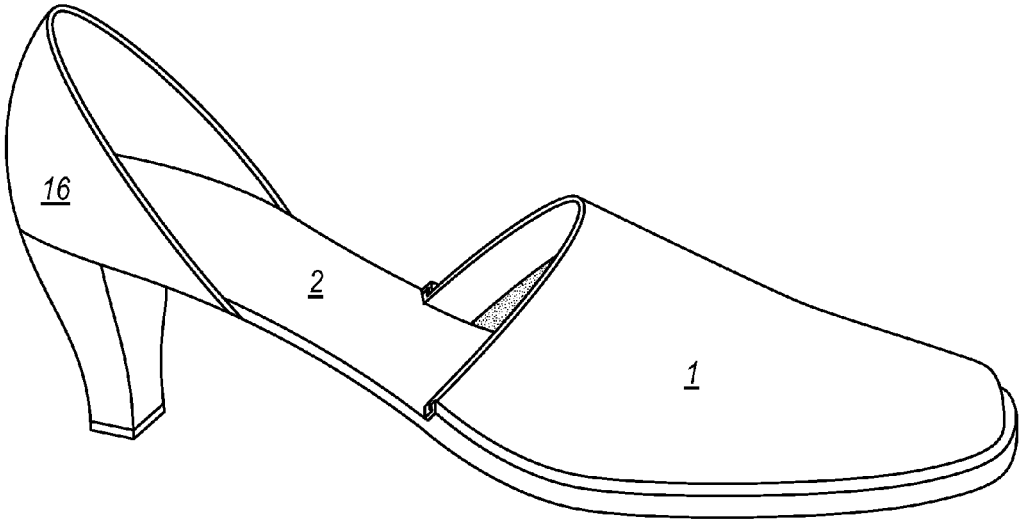
FIG. 1 is a perspective of the complete shoe system with the vamp attached to the shoe base.

FIG. 1 shows an embodiment of the complete invention, which is indistinguishable from a standard shoe. The vamp 1 is shown coupled with the shoe base 2. In this embodiment, the shoe base has a back 16.

Figure 2:
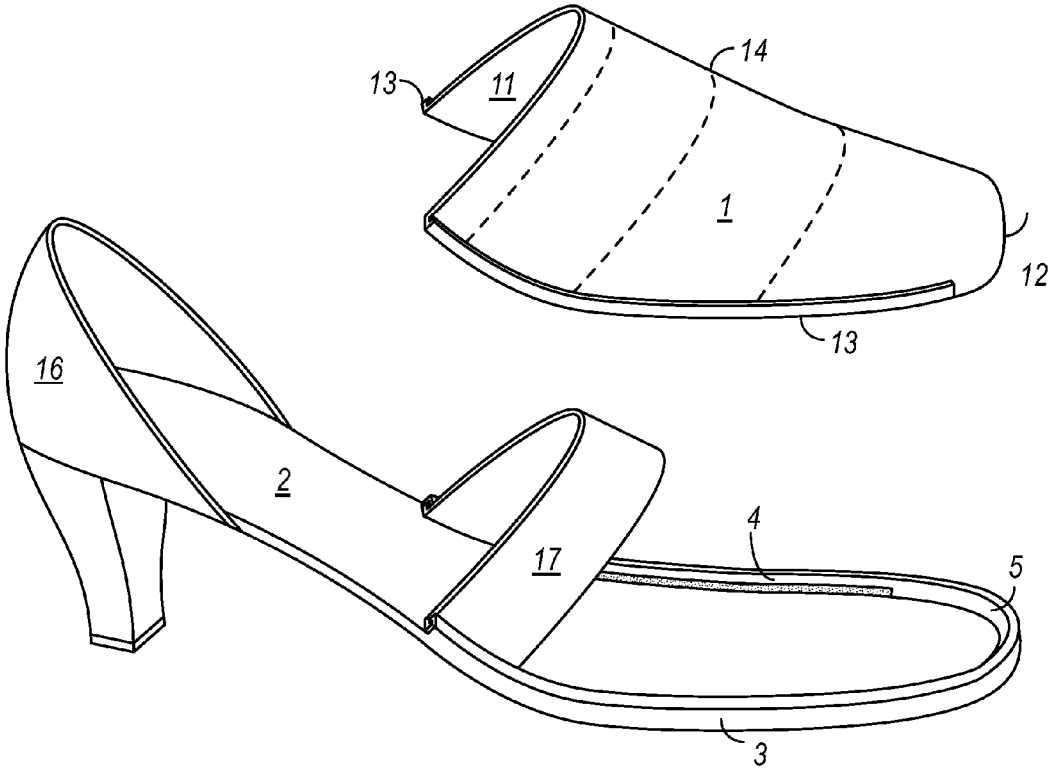
FIG. 2 is an exploded view showing the shoe base, a strengthening strap and vamp.

Now referring to FIG. 2, which is an exploded view of the elements of an embodiment of the shoe, the interchangeable vamp 1 is removable from shoe base 2 so that the wearer can select a vamp with design characteristics to complement her outfit while retaining favored functional characteristics of the shoe base. A strengthening strap 17 may be attached to the shoe base 2 at a location that absorbs the strain placed on the vamp during walking.

Figure 3:
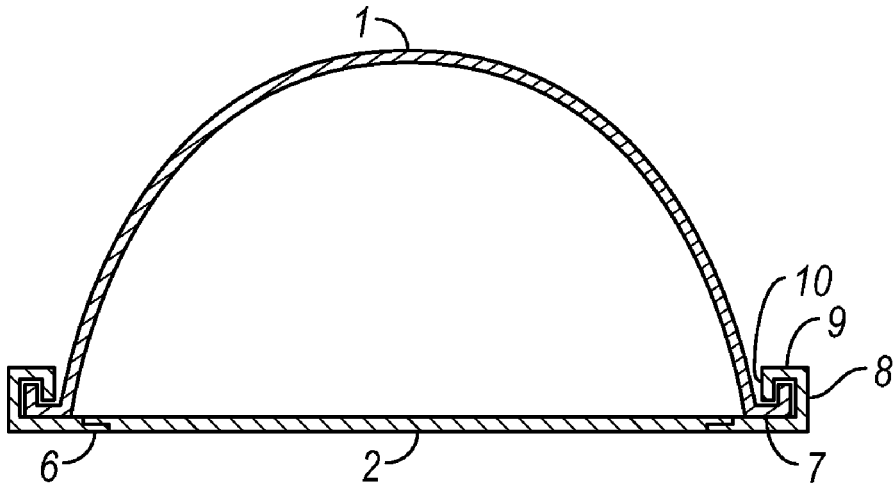
FIG. 3 is a cross-section showing the interlocking rim piece on the base of the shoe and the inner and outer lips of the vamp inserted into the interlocking rim pieces on the inner and outer margins of the shoe base.
Figure 4:
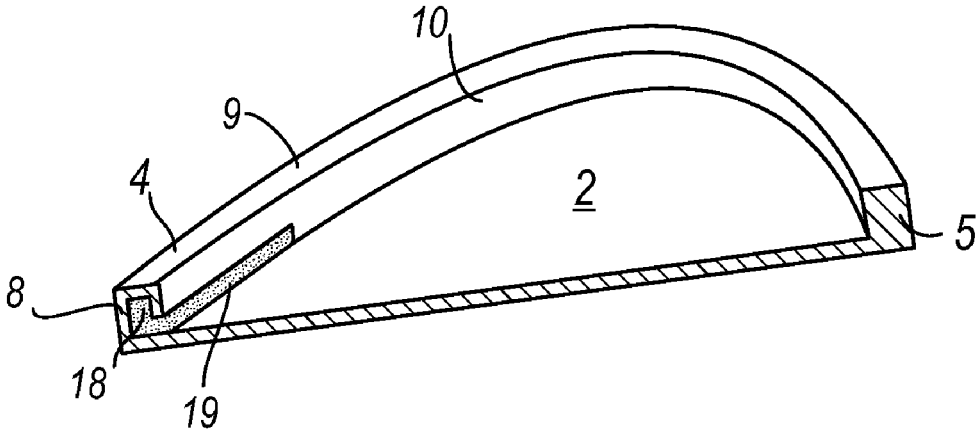
FIG. 4 is a sectional view of the toe area of the shoe base, illustrating the interlocking and abutting rim pieces.

The shoe base 2 has a rim piece 3 positioned along the longitudinal margins of the instep area and toe area of the shoe base. The rim piece 3 is either an interlocking rim piece 4 or an abutting rim piece 5. The rim piece 3 begins as the interlocking rim piece 4 on the inner longitudinal margin of the shoe base in the approximate location of the instep area and continues forward to a location near the distal end of the toe of the shoe, at which point the abutting rim piece 5 continues forward to the tip of the toe of the shoe, around the toe, and along the outer margin to a location near the distal end of the toe of the shoe, at which point the interlocking rim piece 4 continues along the outer margin to the outer midpoint. Referring to FIG. 3, which is a cross-section of the shoe base 2 and vamp 1 illustrating the attachment of the shoe base 2 and vamp 1, the rim piece 3 can be either a separate piece that is anchored to the shoe at the bottom 6 of the shoe base during manufacture, or an integral part of the shoe base. The interlocking rim piece lower wall 7 extends outward from the margin of the shoe base, turns upward, extends up a distance sufficient to form the outer wall of the interlocking rim piece 8, turns inward toward the shoe base, extends a distance sufficient to form the upper wall of the interlocking rim piece 9, then makes a final turn downward to form the inner interlocking rim piece wall 10. Referring to FIG. 4, the inner interlocking rim wall 10 terminates above the interlocking rim piece lower wall 7 to provide an opening 19 sufficient to accommodate the lip 13 of the vamp 1. It is understood that the turns can be of any magnitude or shape forming a semi-closed central channel 18. The interlocking rim piece 4 continues around the toe of the shoe base 2 to the outer midpoint, except that in the distal toe section 5 of the shoe base, the rim piece 3 lacks an opening 19 to a central channel 18, forming an abutting rim piece 5. Sections of interlocking rim piece 4 and abutting rim piece 5 can be alternated along the margins of the shoe base 2 in order to strengthen the rim piece 3 or to prevent movement of the vamp 1 relative to the shoe base 2 during wear. Some embodiments may not require any segments of abutting rim piece 5.

Referring to FIG. 2, the vamp 1 is an inverted U-shaped piece of shoe material such as fabric, leather or patent leather. The vamp 1 is flexible at the instep end 11 and is inflexible at the toe end 12. A lip 13 extends out of those portions of the longitudinal margins of the vamp corresponding to the location of the interlocking rim piece 4 after assembly, then makes a turn upward for a distance corresponding to the height of the central channel 18 in interlocking rim piece 4. The lip 13 is composed of formed material inserted into or affixed to the vamp 1. It is understood that the lip 13 can be any shape allowing the lip to be inserted into and held within the interlocking rim piece 4. An inner lip extends along the inner margin of the vamp and an outer lip extends along the outer margin of the vamp, the inner and outer lip being absent in those areas corresponding to the location of the abutting rim piece 5 on the shoe base. An end abutting rim piece segment 15 may be positioned at or near the instep area of the shoe base corresponding to the proximal end of the lip 13, preventing movement of the vamp 1 within the interlocking rim piece 4. Other methods can provide an abutment for the proximal end of the lip, such as decreasing the height of the rim piece 3 to form an abutment for the proximal end of the lip.

FIG. 3 is a cross-section showing the lip 13 inserted into the interlocking rim piece 4. To exchange the vamp 1 or shoe base 2, the user first inserts the lip 13 through the opening 19 into the central channel 18 of the interlocking rim piece 4 on one edge of the shoe. The distal end of the vamp 12 does not have a protruding lip 13 so that the distal toe segment abuts the abutting rim piece 5 positioned at the distal toe end of the shoe base. The lip 13 is inserted into the interlocking rim piece 4 with a sideways motion. The user completes the attachment of the vamp 1 to the shoe base 2 by flexing and compressing the vamp 1 so that the lip 13 can be inserted into the central channel 18 of the interlocking rim piece 4 on the other side of the shoe.

In a preferred embodiment, portions of the interlocking rim piece 4 and the lip 13 may be made of magnetic material and may be subjected to magnetic charges of opposite polarities so that the interlocking rim piece 4 and lip 13 adhere to each other through the operation of the magnetic attraction between the two.

The vamp 1 may contain resistive flexing material 14 so that the vamp exerts an outward pressure on the lip, providing tension against the outer wall 8 of the interlocking rim piece 4.

Figure 5:
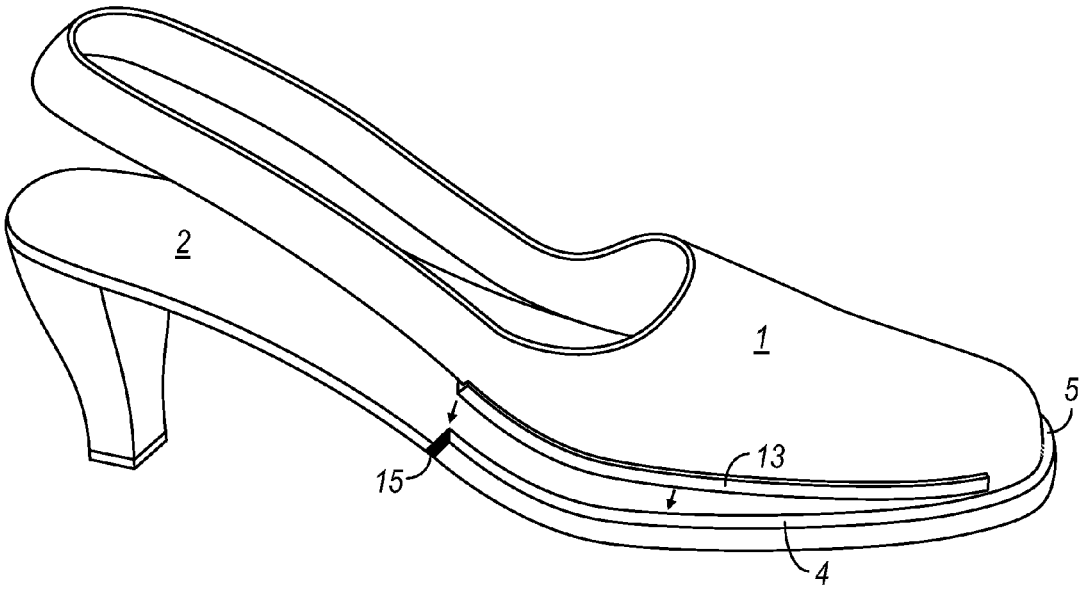
FIG. 5 shows a different embodiment utilizing a strap on the rear of the vamp, forming a sling-back shoe.

FIG. 5 shows another embodiment of the shoe, with the vamp 1 extending backwards into a strap passing around the back of the shoe to form a sling-back and the shoe base 2 having no back 16.

ADVANTAGES

From the description above, a number of advantages of some embodiments of my shoe system with interchangeable base and vamp are evident:

(a) The method for attaching the vamp to the shoe base can be applied to women's dress shoes, the type of shoe for which an interchangeable vamp has great utility due to the high cost of women's dress shoes and the wide variety of design and functional characteristics that might be desirable for a given dress or business ensemble.

(b) The invention allows the shoe to have a closed toe rather than being restricted to styles with an open toe.

(c) The invention allows the shoe to have a thin sole because the coupling means lies above the sole rather than the coupling means being incorporated into a thickened sole.

(d) The interchangeable nature of both the shoe base and vamp mean that the wearer can either substitute multiple vamps using the same shoe base, or substitute multiple shoe bases using the same vamp, giving maximum flexibility for the wearer to adapt the functional and design characteristics to those favored by the wearer.

(e) The interchangeable vamp elements will enable the wearer to utilize numerous vamps with different design characteristics for a smaller cost than the equivalent number of complete pairs of standard shoes.

(f) The interlocking rim piece and lip provide a secure yet unobtrusive coupling of the vamp and shoe base.

(g) The substitution of vamp or shoe base can be performed in a few seconds, which allows the shoe system to be used effectively during daily wardrobe selection.

(h) The shoe system only has two pieces, with no tabs, buckles or small pieces that must be adjusted or that could be misplaced by the wearer.

Accordingly, the reader will see that the interchangeable vamp and shoe base can provide the wearer with a wide variety of dress or business shoes without the expense of purchasing numerous complete pairs of shoes. The wearer can utilize a single vamp with a variety of shoe bases with the desired functional characteristics, for example, selecting a low-heeled shoe base for day wear and a higher heel for evening wear. The shoe can have a closed toe, which is necessary for winter shoes and is often a desirable feature of women's dress or business shoes. The shoe system can also be a sandal, for summer wear or fashion leisure wear.

Although the description above contains many specificities, these should not be construed as limiting the scope of the embodiment but as merely providing illustrations of one or more of the presently preferred embodiments. For example, the vamp can have differing toe shapes, the rim piece can be shaped in a number of ways to interlock with the vamp, the rim piece can be attached to the shoe base in any number of ways or can be an integral part of the sole of the shoe, there can be one or more sections of abutting rim piece interspersed along the margins of the shoe base, with corresponding gaps in the lips to add to the stability of the vamp/base coupling, there can be two or more strengthening straps rather than one, the shape of the interlocking rim piece and lip can be varied to allow for varying materials such as metal, plastic or elastomers to be used, the vamp may be constructed so that its outer edge covers the upper wall of the interlocking rim piece, etc. In addition, the interchangeable vamps and shoe bases could be used for children's shoes.

Thus the scope of the embodiment should be determined by the claims and their legal equivalents, rather than by the examples given.

DRAWINGS

Reference Numerals

1 Vamp
2 Shoe base
3 Rim piece
4 Interlocking rim piece
5 Abutting rim piece
6 Extension of rim piece allowing attachment to shoe base
7 Interlocking rim piece lower wall
8 Interlocking rim piece outer wall
9 Interlocking rim piece upper wall
10 Interlocking rim piece inner wall
11 Proximal end of vamp
12 Distal end of vamp
13 Lip
14 Resistive flexing material
15 End abutting rim piece
16 Back
17 Strengthening strap
18 Central channel
19 Opening to central channel

I claim:

1. A shoe system comprising:

(a) a shoe base having a heel area, an instep area and a toe area and having a rim piece positioned along an inner and outer longitudinal margin of the shoe base from a location substantially near the instep area forward to and encircling the toe area of the shoe base, the rim piece having a lower wall, an outer wall, an upper wall, an inner wall and an opening in the lower edge of the inner wall connected to a central channel, forming an interlocking rim piece, except that at or near the distal end of the toe area of the shoe base, the rim piece lacks the opening in the lower inner wall, forming an abutting rim piece; and (b) a vamp having an inner lip located along those portions of an inner longitudinal margin of the vamp corresponding to the location of segments of interlocking rim piece on the inner longitudinal margin of the shoe base, said inner lip having a shape conforming to the shape of the opening and central channel in the interlocking rim piece on the inner longitudinal margin of the shoe base, and an outer lip located along those portions of the outer longitudinal margin of the vamp corresponding to the location of segments of interlocking rim piece on the outer longitudinal margin of the shoe base, said outer lip having a shape conforming to the shape of the opening and central channel in the interlocking rim piece on the outer longitudinal margin of the shoe base, the inner lip and outer lip being absent in the locations corresponding to segments of abutting rim piece on the shoe base, the vamp being attached to the shoe base by inserting the inner lip of the vamp into the opening in the inner wall of the interlocking rim piece on the inner margin of the shoe base and urging the lip into the central channel, and inserting the outer lip of the vamp into the opening in the inner wall of the interlocking rim piece on the outer longitudinal margin of the shoe base and urging the lip into the central channel.

2. The shoe system of claim 1 where the shoe base has no back and the vamp extends backward to form a strap encircling the heel area, thus comprising a sling-back shoe.

3. The shoe system of claim 1 having a vamp containing resistive flexing material providing tension to force the inner lip and outer lip of the vamp outward against the outer wall of the interlocking rim piece of the shoe base.

4. The shoe system of claim 1 where some or all of the interlocking rim piece and inner lip and outer lip are magnetized with the rim piece and lip being magnetized to opposite polarities.

5. The shoe system of claim 1 in which the shoe base has a back and an ankle strap is attached to the back.

6. The shoe system of claim 1 where a segment of abutting rim piece is positioned at the proximal ends of the rim piece on the inner and outer margins of the shoe base near the instep area so that upon attachment of the vamp to the shoe base, said abutting rim piece is adjacent to the proximal end of the lip so that the vamp is prevented from moving backward.

7. The shoe system of claim 1 where the walls of the interlocking rim piece are of varying thickness or height along the longitudinal margins, producing a central channel that varies in width or height along the longitudinal margin of the shoe, and the lip of the vamp is of a thickness or height corresponding to the width and height of the central channel.

8. The shoe system of claim 1 where one or more segments of abutting rim piece are positioned along the longitudinal margins of the shoe base with corresponding gaps in the inner lip and outer lip of the vamp.

9. The shoe system of claim 1 further comprising an abutting rim piece which has a central channel but lacks an opening to the channel.

10. The shoe system of claim 1 further comprising an abutting rim piece which lacks both a central channel and an opening to the central channel.

11. The shoe system of claim 1 further comprising an open-toe shoe having a vamp in which the inner and outer margins of the vamp have a lip and the rim piece is an interlocking rim piece in those locations corresponding to the locations of the inner and outer lips of the vamp upon attachment and is an abutting rim piece in other locations in the toe area and instep area.

12. The shoe system of claim 1 having one or more strengthening straps attached to the shoe base such that the tension exerted on the vamp during walking is absorbed by the strengthening strap rather than the vamp.

13. The shoe system of claim 12 further comprising a strengthening strap constructed of shoe vamp material so that the shoe base can be worn either alone as a sandal-type shoe or with the vamp attached.

* * * * *